US009480892B2

(12) United States Patent
Loudenslager et al.

(10) Patent No.: US 9,480,892 B2
(45) Date of Patent: Nov. 1, 2016

(54) FASTENER FOR A GOLF BAG

(71) Applicant: Karsten Manufacturing Corporation, Phoenix, AZ (US)

(72) Inventors: John H. Loudenslager, Phoenix, AZ (US); David A. Higdon, Glendale, AZ (US); Ryan J. Bruce, Phoenix, AZ (US)

(73) Assignee: KARSTEN MANUFACTURING CORPORATION, Phoenix, AZ (US)

( * ) Notice: Subject to any disclaimer, the term of this patent is extended or adjusted under 35 U.S.C. 154(b) by 177 days.

(21) Appl. No.: 14/137,790

(22) Filed: Dec. 20, 2013

(65) Prior Publication Data

US 2015/0174462 A1 Jun. 25, 2015

(51) Int. Cl.
*A63B 55/00* (2015.01)

(52) U.S. Cl.
CPC ..... *A63B 55/408* (2015.10); *A63B 55/60* (2015.10); *A63B 2209/10* (2013.01); *Y10T 29/49826* (2015.01)

(58) Field of Classification Search
CPC .. A63B 55/00; A63B 55/008; A63B 55/005; A63B 55/004; A63B 55/045
USPC ..... 206/315.3, 315.1, 315.2, 315.4, 315.6, 206/315.5; 224/148.2, 184, 259, 274, 637, 224/645; 340/568; 70/58; 24/298, 171
See application file for complete search history.

(56) References Cited

U.S. PATENT DOCUMENTS 1,798,638 A * 3/1931 Stone ..... A63B 55/00 206/315.6
4,420,024 A * 12/1983 Clayton ..... A63B 55/00 190/107
4,625,862 A * 12/1986 Clayton ..... A63B 60/62 206/315.3
5,524,753 A * 6/1996 Murphy ..... A63B 55/00 206/315.6
5,871,183 A 2/1999 Milluzzi
6,196,432 B1 3/2001 Aliano, Jr.
6,220,432 B1 * 4/2001 Tan ..... A45C 13/42 206/315.3
6,849,038 B2 * 2/2005 Straface ..... A45C 5/02 493/226
6,901,979 B1 * 6/2005 Herold ..... A63B 55/406 150/159
6,910,491 B2 * 6/2005 Wu ..... A45B 25/12 135/34.2
8,584,861 B2 * 11/2013 Porath ..... A45C 9/00 206/315.2
2006/0011682 A1 * 1/2006 Christensen et al. ..... B60R 7/08 224/274
2006/0081668 A1 4/2006 Haines et al.
2007/0017946 A1 1/2007 Orr
2007/0095867 A1 * 5/2007 Tomlin ..... A45F 3/04 224/148.2
2008/0105575 A1 * 5/2008 Taylor ..... A63B 55/00 206/315.3
2012/0223112 A1 9/2012 Campbell
2012/0325699 A1 12/2012 Herron et al.

* cited by examiner

*Primary Examiner* — Fenn Mathew
*Assistant Examiner* — Cynthia Collado

(57) ABSTRACT

A golf bag including a body defining a housing adapted to receive one or more golf clubs, and extending between a bottom portion and a top portion. The golf bag includes a fastener coupled to the body. The fastener includes a first end coupled to the body, a second end opposite the first end, and a locking member. The golf bag also includes a first gripping member coupled to the body and a second gripping member coupled to the fastener. The first gripping member and the second gripping member are configured to receive a cart strap therebetween.

16 Claims, 8 Drawing Sheets

FASTENER FOR A GOLF BAG

FIELD

The present disclosure relates to an accessory to support a cart (i.e., golf cart or pull cart) strap fastener for golf bags.

BACKGROUND

Most golf bags may be in the form of a tubular fabric or leather container having a generally cylindrical configuration with a closed bottom end and an open top end through which golf clubs are inserted into and removed from the golf bag. Although golf bags are manufactured in a variety of sizes and materials so as to better suit various intended uses, golf bags are conventionally grouped into two basic classes. The first class of golf bags are generally larger and heavier golf bags designed to be carried by a pull cart or transported by a golf cart whereas the second class of golf club bags are generally smaller and lighter golf bags designed to be carried by the individual during play. In particular, golf bags of the first class are usually constrained relative to the cart by a cart strap. Typically, a cart strap is strapped across the body of a golf bag and supports the bag laterally, but offers little to no axial support. Accordingly, when a golf cart makes sharp turns or hits bumps, the bag bounces, shifts, twists, and exerts other stresses on the bag that result in unnecessary wear and tear.

Accordingly, there is a need in the art for a golf cart or pull cart strap system that increases the support provided by the strap both in an axial and lateral support position. This need will ideally decrease or eliminate unnecessary wear and tear on a golf bag.

BRIEF DESCRIPTION OF THE DRAWINGS

Corresponding reference characters indicate corresponding elements among the various views of the drawings. The headings used in the figures should not be interpreted to limit the scope of the claims.

DESCRIPTION

Before any embodiments of the apparatus, methods, and articles of manufacture are explained in detail, it is to be understood that this disclosure is not limited in its application to the details of construction and the arrangement of components set forth in the following description or illustrated in the following drawings. The apparatus, methods, and articles of manufacture described herein may include other embodiments and may be practiced or carried out in various ways.

Figure 1:
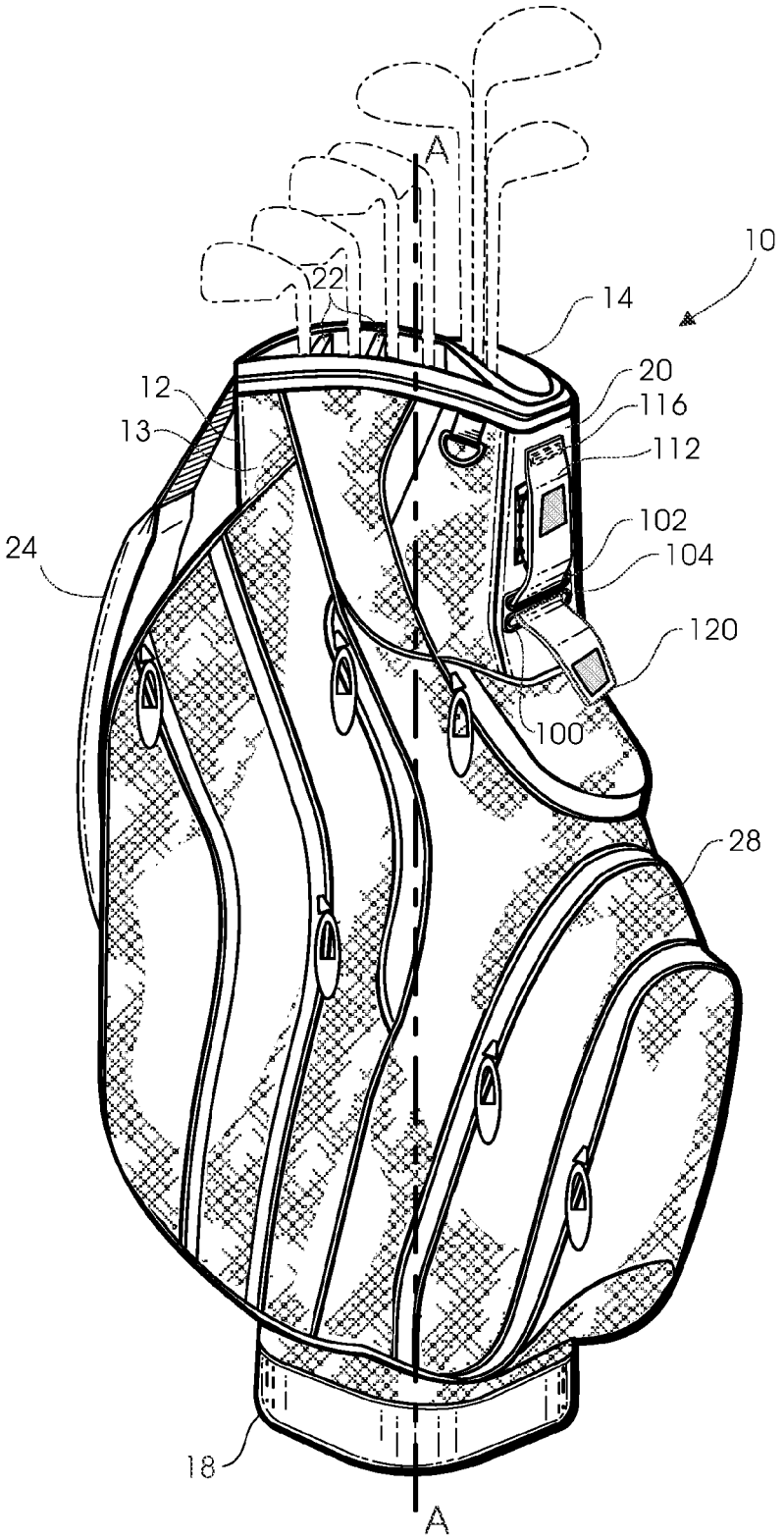
FIG. 1 is a perspective view of a golf bag with a fastener according to one embodiment of the apparatus, methods, and articles of manufacture described herein the fastener being in a first position.
Figure 2:
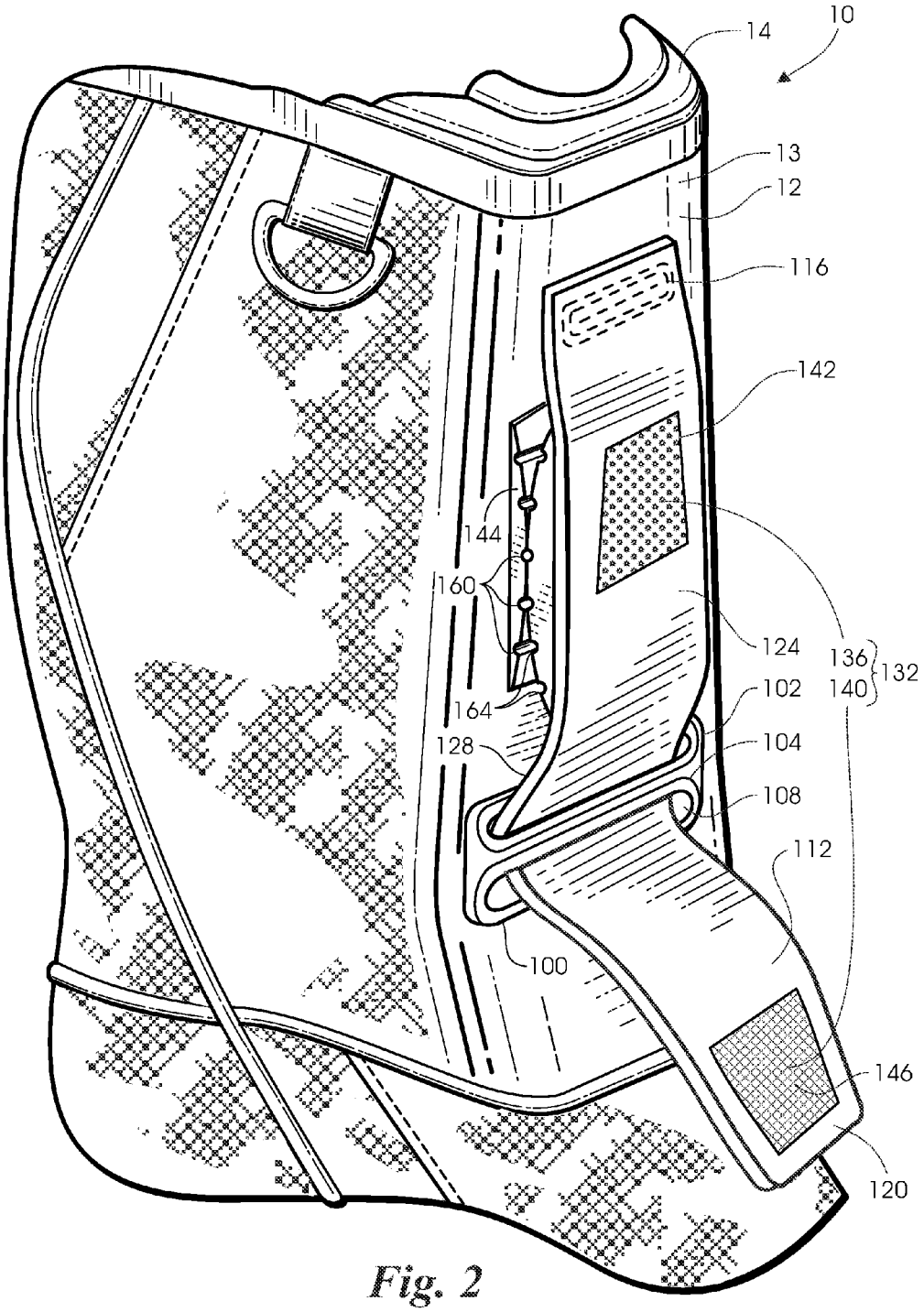
FIG. 2 is a detailed perspective view of the fastener of FIG. 1 in the first position.

With reference to FIG. 1, a golf bag 10 comprises a generally tubular body 12 that may include a housing 13 extending between an open, top portion 14 and a closed, bottom portion 18. The top portion 14 may be located on a top end of the body 12, and the bottom portion 18 may be located opposite of the top portion 14 on the bottom end of the body 12. A longitudinal axis A is defined between the top portion 14 and the bottom portion 18. The housing 13 may be formed of nylon or other lightweight fabric and is adapted to receive one or more golf clubs (shown in broken lines). A ring-shaped member such as a throat 20 is stitched or otherwise mounted to the top portion 14 of the body 12. The throat 20 includes a plurality of dividers 22 that segregate golf clubs with the golf clubs being inserted into and removed from the bag 10 through the throat 20. The bottom portion 18 may be rigid and similarly mounted to the bottom end of the body 12. Both the bottom portion 18 and the throat 20 may be molded or otherwise formed of a suitable synthetic resin in a manner well known in the art. The golf bag 10 may also include various other features normally associated with golf bags such as a shoulder strap 24, a handle (now shown) and at least one accessory pocket 28. The golf bag 10 also includes an attachment mechanism 52 coupled to the body 12 and positioned near the throat 20. A generally rigid spine (not shown) interconnects the throat 20 and the bottom portion 18 to keep the throat 20 and the bottom portion 18 in a spaced-apart relationship. The spine may be made of wood, fiberglass or other suitable rigid lightweight material. Lower end of the spine may be attached by a hinge to the bottom portion 18 by means of a length of fabric or other flexible material forming a fabric hinge which permits the bottom portion 18 to pivot relative to spine. As can be determined from the foregoing, the side of the body 12 diametrically opposite the spine may be partially collapsible because the spine extends along only one side of the golf bag 10. Therefore, when placed upright resting on the bottom portion 18, the golf bag 10 may collapse toward this collapsible side.

With respect to FIGS. 2-7, the golf bag 10 further includes positioning loop 100 coupled to the body 12 and including a coupling member 102 and a support member 104. The coupling member 102 is coupled to the body 12 and the support member 104 is coupled to and spaced apart from the coupling member 102. An aperture 108 is defined between the support member 104 and the body coupling member 102. The positioning loop 100 is constructed from plastic, metal, fabric or any other durable material. In alternative embodiments, the support member 104 is directly, integrally coupled to the body 12 such that the aperture 108 is defined between the support member 104 and the body 12.

The golf bag 10 also includes an adjustable fastener or clamp 112 that is parallel to longitudinal axis A and provides a cart strap passage system. The fastener 112 and includes a first end 116 coupled to the body 12 and a second end 120 that is opposite and moveable relative to the first end 116. The fastener is coupled to the top of the bag in the illustrated embodiments but may be coupled to other parts of the bag in other embodiments. Further, in the illustrated embodiment, the fastener 112 is a strap constructed from fabric, polyester, or any other suitable material capable of withstanding stress exerted by the golf bag. At least a portion of the fastener 112 is received by and extends through the aperture 108. The fastener 112 includes a first side 124 and a second side 128. The fastener 112 includes a locking member 132 that includes a first locking member 136 and a second locking member 140, which are spaced apart from one another on the first side 124. The first locking member 136 and the second locking member 140 have mating or complimentary surfaces 142, 146 and are configured to removably and adjustably secure the second end 120 of the fastener relative to the first end 116 of the fastener 112. In the illustrated embodiment, the first locking member 136 and the second locking member 140 are hook-and-loop fasteners (e.g., Velcro, metal, plastic hook and fastener system, and the like). In other embodiments, the locking members 136, 140 might be a coupled by a snap or button fastener or by a magnetic coupling, for example.

The golf bag 10 also includes a first gripping member 144 and a second gripping member 148, which together constitute a gripper. The first gripping member 144 is coupled to the body 12 and the second gripping member 148 is coupled to the second side 128 of the fastener 112. The first gripping member 144 and the second gripping member 148 are configured to receive a cart strap 152, 156 (e.g., of a golf cart 176 or a pull cart 180) therebetween. Each of the first gripping member 144 and the second gripping member 148 are substantially arcuately shaped and includes a plurality of grooves 160, 164. The grooves 160 of the first gripping member 144 are offset from the grooves 164 of the second gripping member 148 such the grooves bite opposite sides of the cart strap 152, 156 when disposed therebetween. It should also be understood that the gripping members 144, 148 may have other configurations. For example, there may be more or fewer grooves 160, 164 or be substantially rectangular rather than arcuately shaped, as illustrated. Additionally, the gripping members 160, 164 are formed from rubber, plastic, fabric, or any other suitable material. The length 168 of the gripping members 144, 148 may be slightly longer than the width 172 of the cart strap 152, 156.

Figure 3:
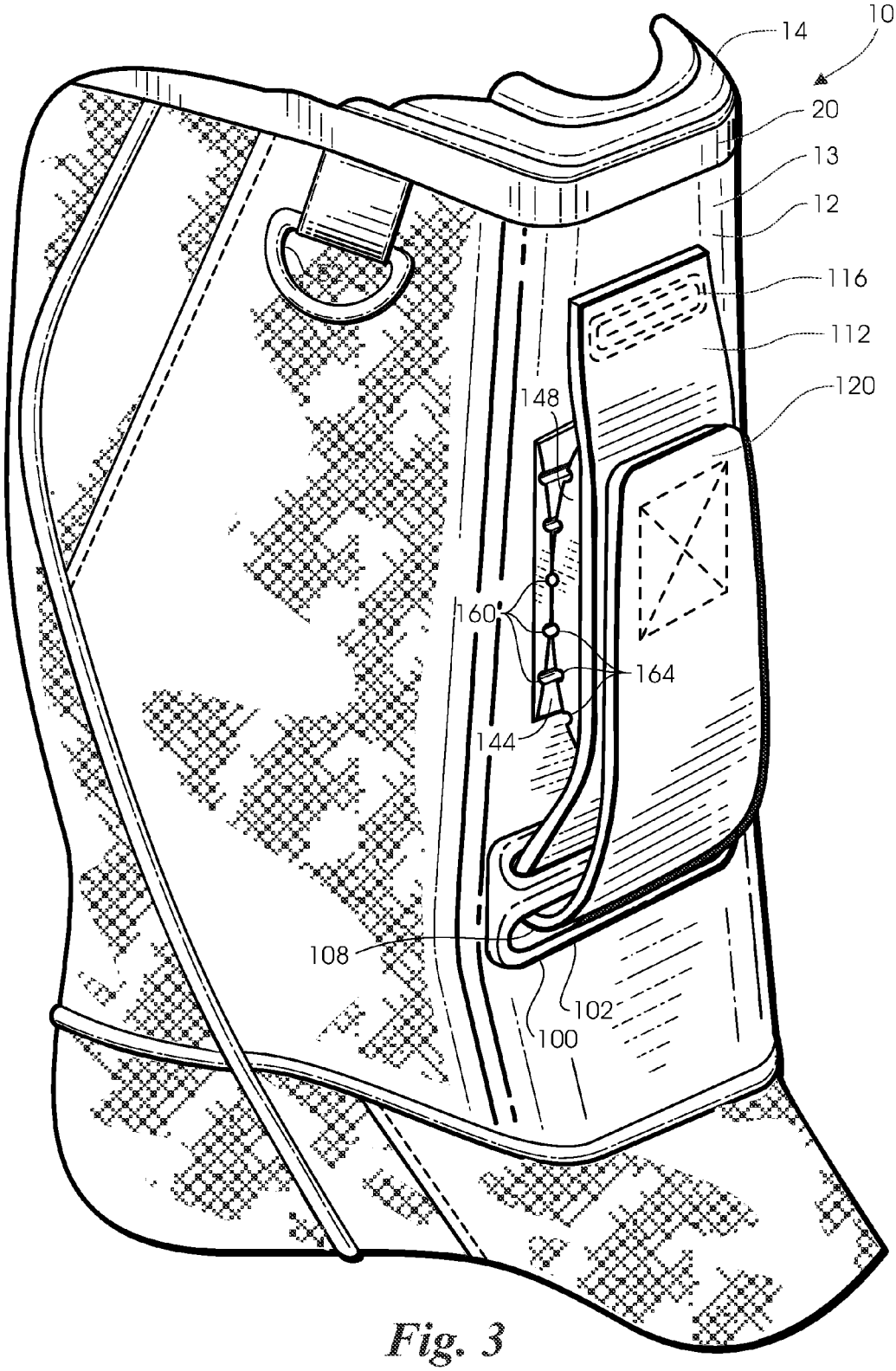
FIG. 3 is a detailed perspective view of the fastener of FIG. 1 in a second position.
Figure 4:
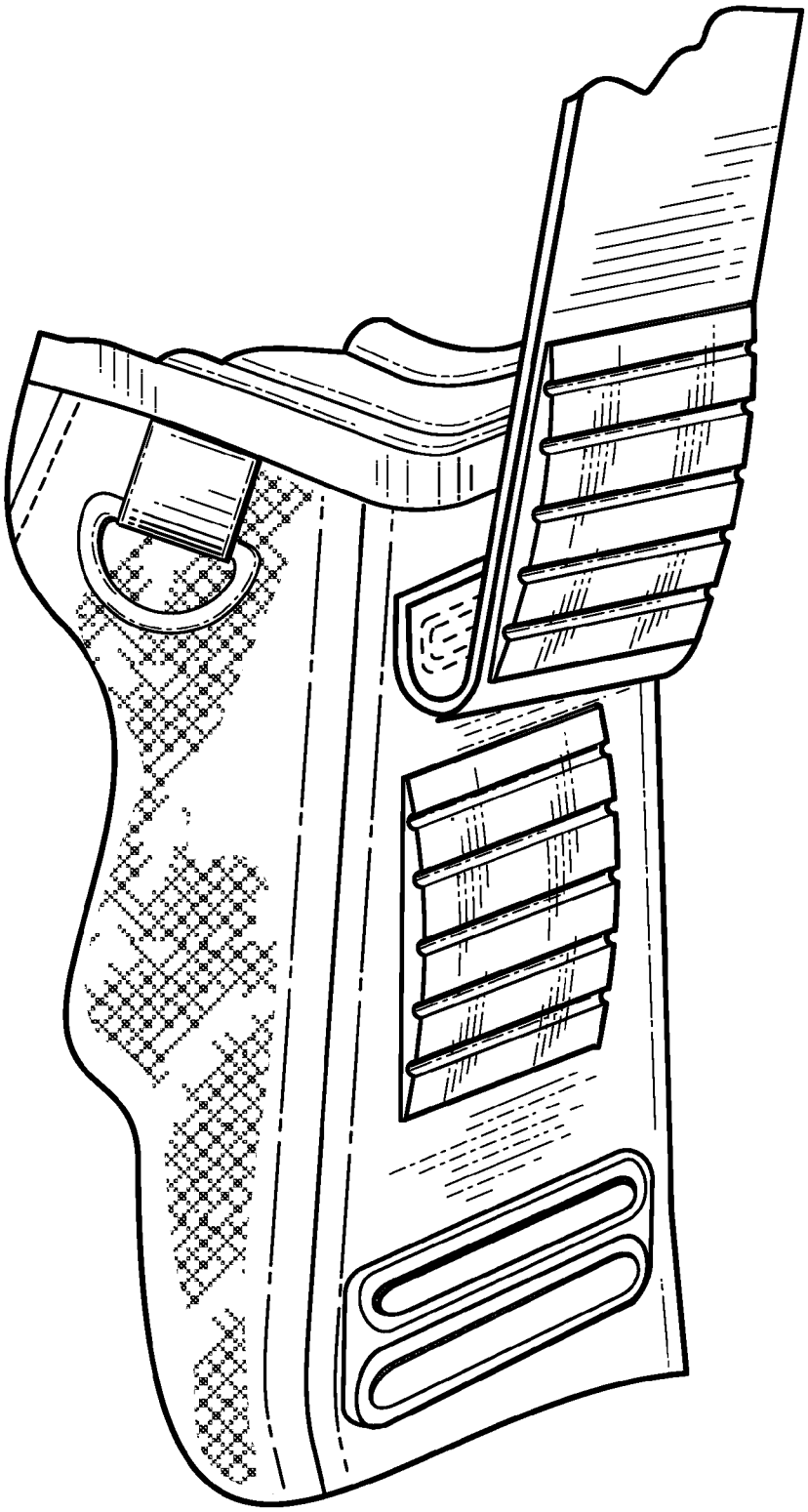
FIG. 4 is a perspective view of the fastener of FIG. 1.
Figure 5:
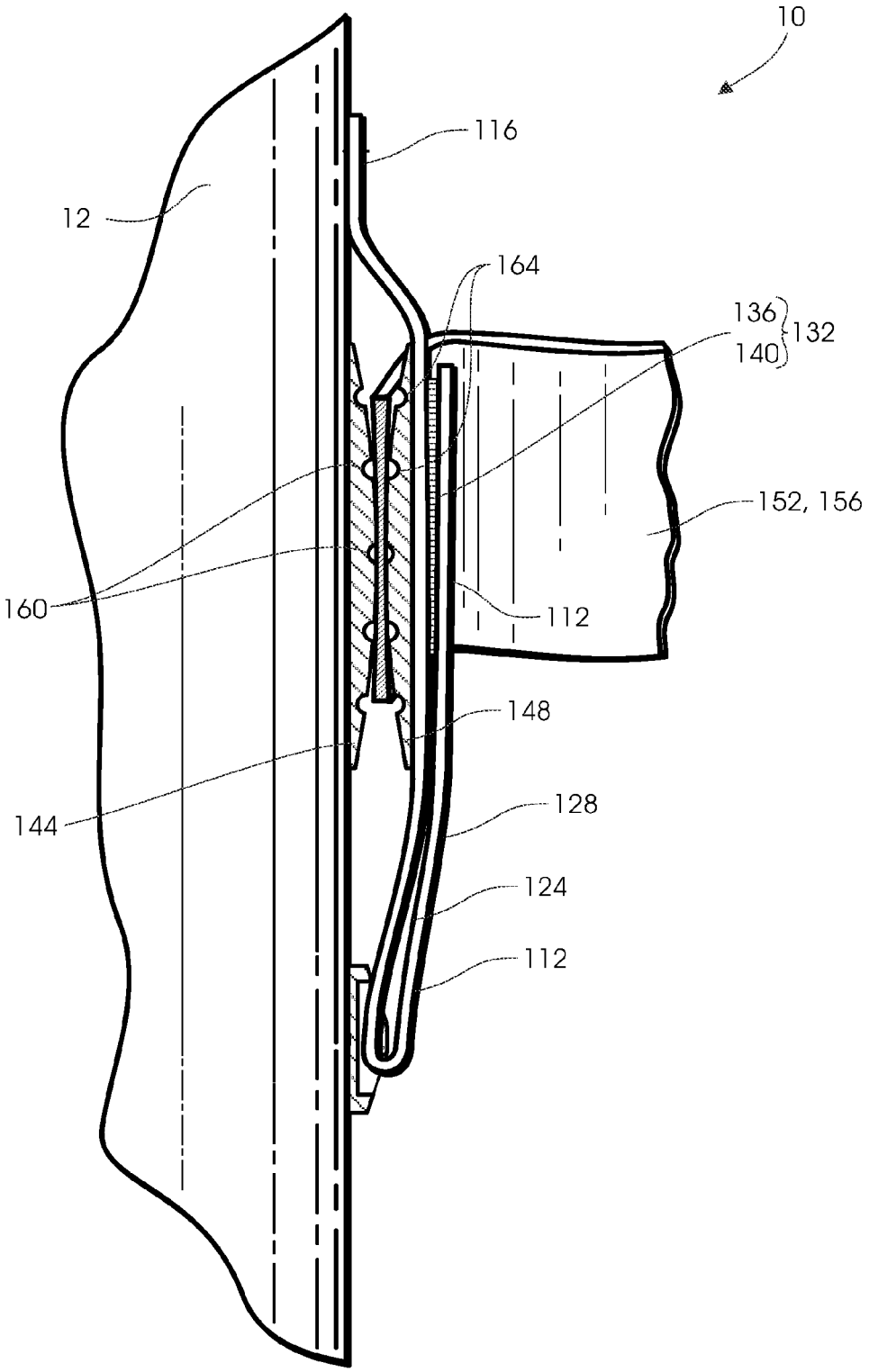
FIG. 5 is a side view of the fastener of FIG. 1.
Figure 6:
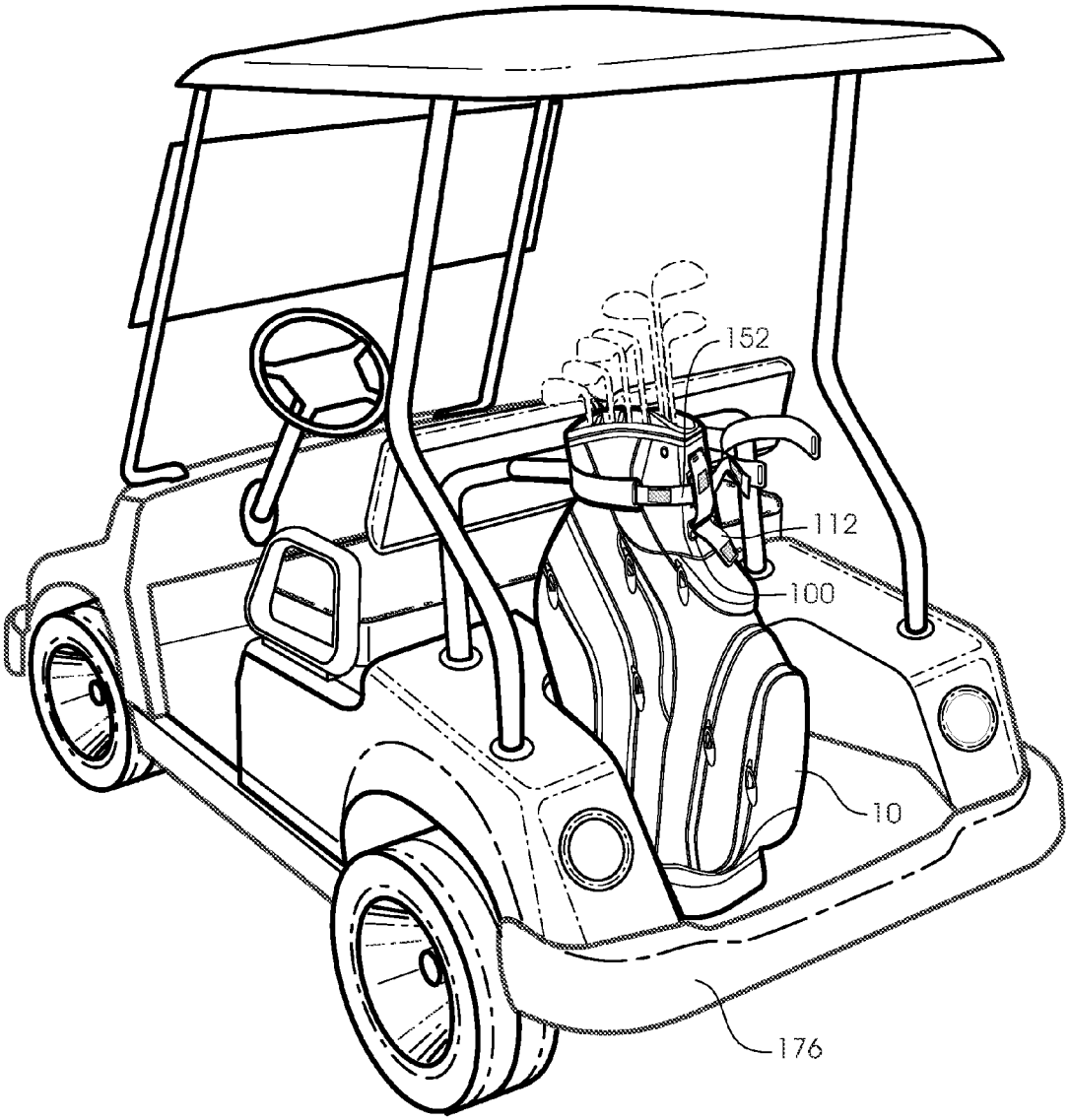
FIG. 6 is a perspective view of the golf bag of FIG. 4 attached to a golf cart, the fastener being used to secure a golf cart strap.
Figure 7:
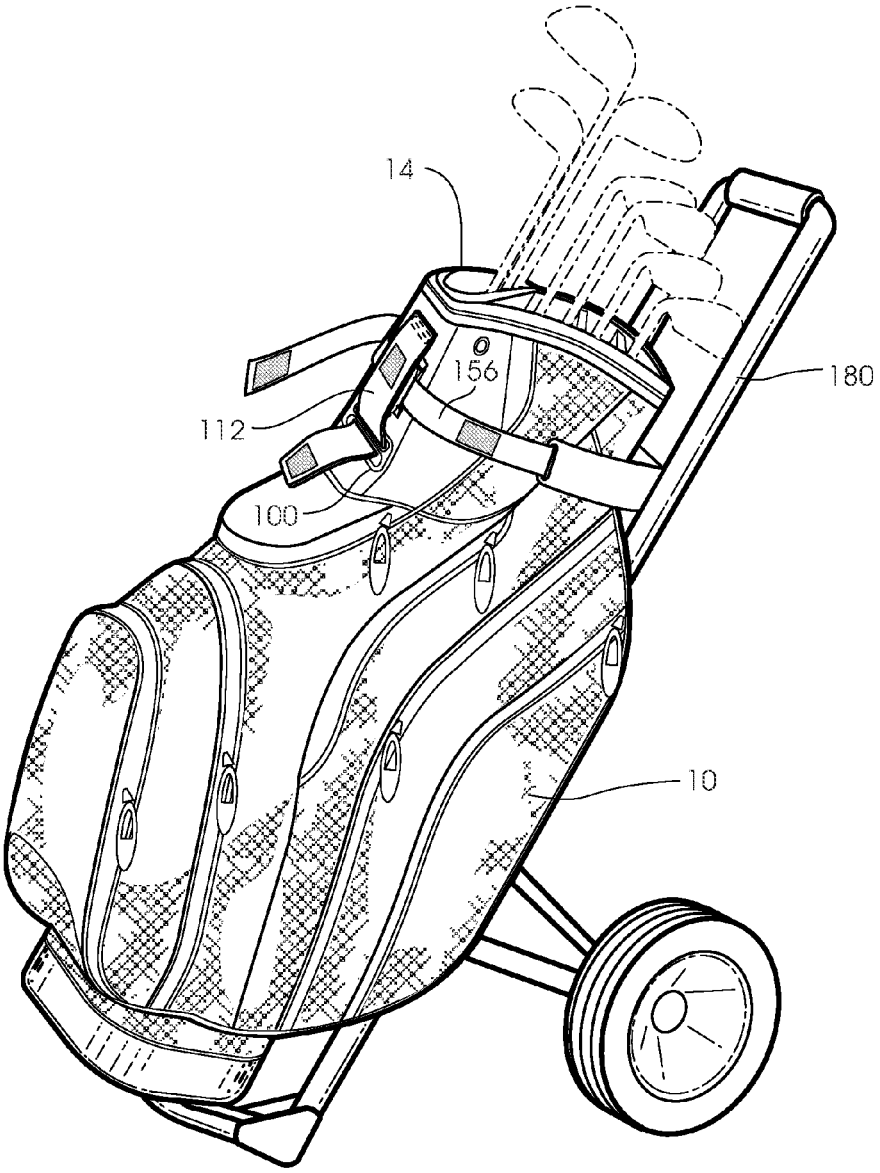
FIG. 7 is a perspective view of the golf bag of FIG. 4 attached to a pull cart, the fastener being used to secure a pull cart strap.

The fastener 112 is movable between a first, locked position (FIG. 2) and a second, unlocked position (FIG. 3). When in the locked position, the locking members 136, 140 secure the fastener 112 with respect to the body 12. As illustrated in FIGS. 2-5, the fastener 112 loops around the support member 104 such that the second locking member 140 contacts, communicates, or interlocks with the first locking member 136 thereby securing the second end 120 of the fastener 112 relative to the first end 116 of the fastener 112. When the golf bag 10 is attached to either the golf cart 176 or the pull cart 180, a cart strap 152, 156 extends in between the first gripping member 144 and the second gripping member 148. Therefore, in the locked position the first gripping member 148 and the second gripping member 144 contact opposite sides of the cart strap 152, 156. When the golf bag is not secured to the cart 176, 180, the first gripping member 144 and the second gripping member 148 contact one another.

With respect to FIG. 3, when in the unlocked position the fastener 112 is movable with respect to the body 12. Additionally, the first gripping member 144 is spaced apart from the second gripping member 148. While the fastener 112 is in the unlocked position, the cart strap 152, 156 may be inserted and removed from a passage or space 184 disposed between the first gripping member 144 and the second gripping member 148.

In operation, the fastener 112 is used to secure the cart strap 152, 156 to the golf bag 10 and reduce movement therebetween when the golf bag 10 is secured to the cart 176, 180. As such, beginning from the locked position, the complementary surfaces 142, 146 of the first locking member 136 and the second locking member 140 are decoupled from one another to achieve the unlocked position. The second end 120 of the fastener 112 is movable relative to the first end 116 in order to adjust a distance 190 between the first gripping member 144 and the second gripping member 148. The user then inserts the cart strap 152, 156 between the first gripping member 144 and the second gripping member 148. Once the golf bag 10 is appropriately placed and the strap 152, 156 tightened about the bag 10, the complimentary surfaces 142, 146 of the first locking member 136 and the second locking member 140 are coupled to one another to achieve the locked position. When the locking members 136, 140 are coupled, the first gripping member 144 and the second gripping member 148 contact opposite sides of the cart strap 152, 156. As illustrated, the grooves 160, 164 on each of the first gripping member 144 and the second gripping member 148 prevent the cart strap 152, 156 from slipping there between. Also, the fastener 112 provides additional axial and lateral support such that the fastener 112 prevents the cart strap 152, 156 from moving vertically or horizontally relative to the bag 10 thereby stabilizing the golf bag on the cart. Accordingly, the life of the golf bag 10 can be extended by eliminating unnecessary wear and tear on a golf bag 10 resulting from sharp turns, hits, bumps and the like and which cause forces and stresses that force the bag to bounce, shift, twist, and otherwise move.

Figure 8:
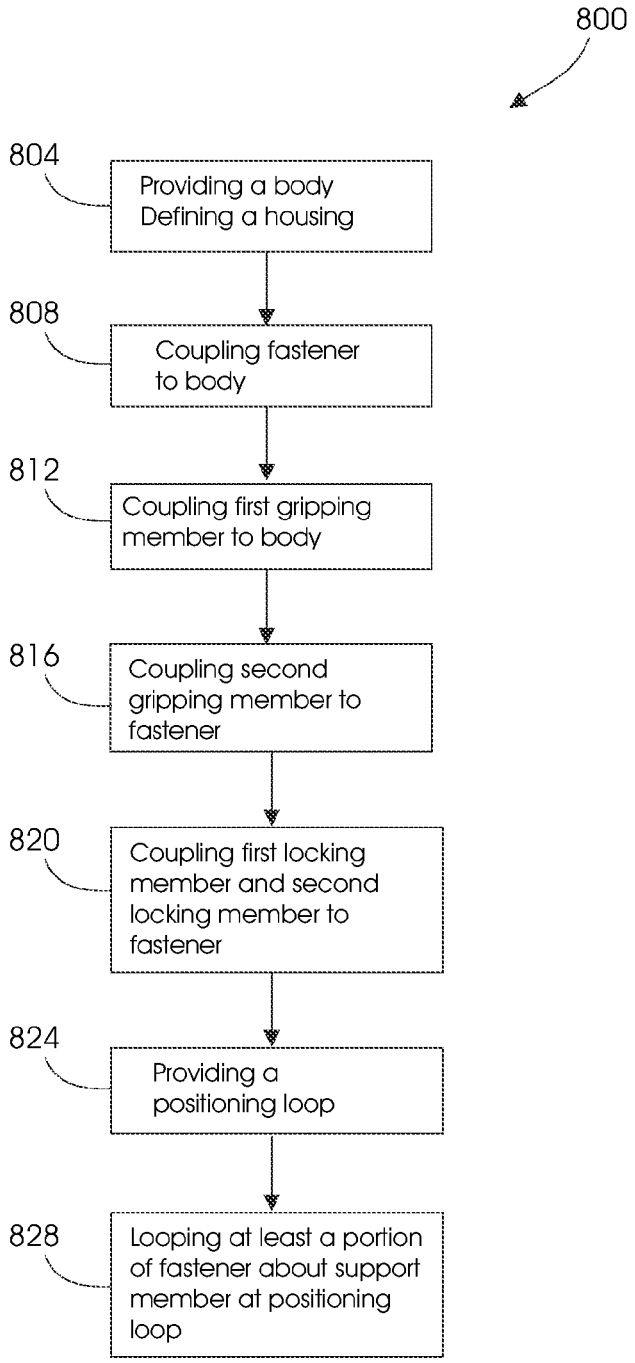
FIG. 8 illustrates a method of manufacture of the golf bag including the fastener of FIG. 1.

With reference to FIG. 8, the golf bag 10 is manufactured by method 800 including providing a body defining a housing 13 extending between a bottom portion and a top portion, which is adapted to receive one or more golf clubs at step 804. At step 808, the fastener 112 is coupled to the body. At step 812, the first gripping member 144 is coupled to the body 12 and the second gripping member 148 is coupled to the fastener 112 at step 816. The method also includes coupling the first locking member 136 and the second locking member 140 to the first side 124 of the fastener 112 at step 820. At step 824, the golf bag 10 is provided with the positioning loop 100. At least a portion of the fastener 112 is looped about the support member 104 such that the second end 120 of the fastener 112 is fixed with respect to the body 12 at step 828.

Additionally, while the figures may depict particular body 12, and top and bottom portions 14 and 18, respectively, the apparatus, methods, and articles of manufacture described herein are not limited in this regard.

It should be understood from the foregoing that, while particular embodiments have been illustrated and described, various modifications can be made without departing from the spirit and scope of the disclosure as will be apparent to those skilled in the art. Such changes and modifications are within the scope and teachings of this disclosure as defined in the claims appended hereto.

Various features and advantages of the apparatus, methods, and articles of manufacture described herein are set forth in the following claims.

What is claimed is:

1. A golf bag comprising:

a body defining a housing extending between a bottom portion and a top portion, the housing adapted to receive one or more golf clubs;

a fastener coupled to the body, the fastener including a first end coupled to the body, a second end opposite the first end, and a locking member wherein the locking member includes a first locking member that is spaced apart from a second locking member on a first side of the fastener, the first locking member and the second locking member including complimentary surfaces;

a first gripping member coupled to the body; and a second gripping member coupled to the fastener, wherein the first gripping member and the second gripping member are configured to receive a cart strap therebetween;

a positioning loop comprising:

a coupling member coupled to the body;

a support member coupled to and spaced apart from the coupling member, and an aperture defined between the support member and the coupling member, wherein at least a portion of the fastener extends through the aperture and loops around the support member such that a surface of the first locking member interlocks with a surface of the second locking member.

2. The golf bag of claim 1, wherein when in a locked position, the locking member secures the fastener with respect to the body, and the first gripping member and the second gripping member either contact opposite sides of the cart strap or contact one another.

3. The golf bag of claim 1, wherein when in an un-locked position, the fastener is movable with respect to the body, and the first gripping member is spaced apart from the second gripping member.

4. The golf bag of claim 1, wherein the fastener includes a first side and a second side, the locking member being coupled to the first side and the second gripping member being coupled to the second side.

5. The golf bag of claim 1, wherein the fastener is adjustable.

6. The golf bag of claim 1 wherein the fastener is a strap.

7. A golf bag comprising:

a body defining a housing extending between a bottom portion and a top portion, the housing adapted to receive one or more golf clubs;

a fastener coupled to the body and including a first end coupled to the body and a second end opposite the first end, the fastener movable between an unlocked position and a locked position; and a first gripping member coupled to the body; and a second gripping member coupled to the fastener, wherein the first gripping member and the second gripping member are configured to receive a cart strap therebetween;

a positioning loop comprising:

a coupling member coupled to the body;

a support member coupled to and spaced apart from the coupling member, and an aperture defined between the support member and the coupling member, wherein at least a portion of the fastener extends through the aperture and loops around the support member such that a surface of a first locking member interlocks with a surface of a second locking member.

8. The golf bag of claim 7, further comprising a locking member including a first locking member that is spaced apart from a second locking member on a first side of the fastener, the first locking member and the second locking member having complimentary surfaces.

9. The golf bag of claim 7, wherein when in the locked position, the fastener is secure with respect to the body, and the first gripping member and the second gripping member either contact opposites sides of the cart strap or contact one another.

10. The golf bag of claim 7, wherein when in the un-locked position, the fastener is movable with respect to the body, and the first gripping member is spaced apart from the second gripping member.

11. The golf bag of claim 7, wherein the fastener includes a first side and a second side, a locking member being coupled to the first side and the second gripping member being coupled to the second side.

12. The golf bag of claim 7, wherein the fastener is adjustable.

13. The golf bag of claim 7, wherein the fastener is a strap.

14. A method of manufacturing of a golf bag, the method comprising:

providing a body defining a housing extending between a bottom portion and a top portion, the housing adapted to receive one or more golf clubs;

coupling a fastener to the body, the fastener including a first end coupled to the body and a second end opposite the first end;

coupling a first gripping member to the body; and coupling a second gripping member to the fastener;

providing a positioning loop including a coupling member that is coupled to the body and a support member coupled to and spaced apart from the coupling member, providing an aperture defined between the support member and the coupling member, and looping at least a portion of the fastener about the support member such that the second end of the fastener is fixed with respect to the body.

15. The method of claim 14 further comprising coupling a locking member to the fastener, the locking member including a first locking member and a second locking member, the first locking member and the second locking member being spaced apart from one another and having complimentary surfaces.

16. The method of claim 15, further comprising coupling a locking member to the fastener, the locking member and the second gripping member being coupled to opposite sides of the fastener.

* * * * *